United States Patent [19]

Piazzola

[11] Patent Number: 4,504,734

[45] Date of Patent: Mar. 12, 1985

[54] ELECTRIC RESISTANCE HEATING ASSEMBLY FOR PLASTICS MATERIAL EXTRUDERS

[76] Inventor: Gaetano Piazzola, Viale Borri, 148, 21100 Varese, Italy

[21] Appl. No.: 550,295

[22] Filed: Nov. 9, 1983

[30] Foreign Application Priority Data

Nov. 12, 1982 [IT] Italy ..... 23452/82[U]

[51] Int. Cl.[3] ..... H05B 3/02

[52] U.S. Cl. ..... 219/550; 219/535; 219/536; 219/552; 338/213

[58] Field of Search ..... 219/527, 528, 535, 532, 219/550, 536, 552, 546, 548; 338/213; 174/138 J

[56] References Cited

U.S. PATENT DOCUMENTS

| | | | |
|---|---|---|---|
| 795,803 | 7/1905 | Vedovelli | 338/213 |
| 819,654 | 5/1906 | Heath | 338/213 X |
| 845,225 | 2/1907 | Fleming | 338/213 X |
| 2,549,944 | 4/1951 | Steiner | 219/550 |
| 2,722,597 | 11/1955 | Steiner | 219/550 X |
| 3,036,187 | 5/1962 | Goldstaub et al. | 219/550 X |
| 3,393,297 | 7/1967 | Hart | 219/535 X |
| 3,887,790 | 6/1975 | Ferguson | 219/535 |
| 4,255,649 | 5/1981 | Fisher | 219/550 |
| 4,410,793 | 10/1983 | Fischer et al. | 219/460 |

FOREIGN PATENT DOCUMENTS

| | | | |
|---|---|---|---|
| 516395 | 1/1931 | Fed. Rep. of Germany | 219/550 |
| 634115 | 8/1936 | Fed. Rep. of Germany | 219/550 |
| 1194970 | 11/1959 | France | 219/550 |
| 260329 | 9/1928 | Italy | 219/550 |

*Primary Examiner*—Volodymyr Y. Mayewsky
*Attorney, Agent, or Firm*—Bucknam and Archer

[57] ABSTRACT

The assembly comprises coiled resistances passing through one or more holes as transversely formed in ceramics material strips so shaped as to be effective to be coupled to one another in a partial sliding relationship and to provide a structure having void spaces, engageable by the electric resistances and being restrained, on the outside thereof, by a net band wound as a ring and provided with means for removably coupling its end portions.

3 Claims, 4 Drawing Figures

ELECTRIC RESISTANCE HEATING ASSEMBLY FOR PLASTICS MATERIAL EXTRUDERS

BACKGROUND OF THE INVENTION

The present invention relates to an electric resistance heating assembly, provided with heating resistances embedded in ceramics material strips coupled to one another, effective to be particularly used for plastics material extruder apparatus.

As it is known, the plastics material extrusion method comprises a step of plasticizing the material by means of heat provided from the outside and/or developed in the material itself due to the inner friction caused by the mechanical working.

It is also known that the mentioned outside heat is generally supplied by heating electric resistances, which are suitably designed and encompass the extruder barrel.

More specifically, said heating resistances consist conventionally of a number of coiled wires, having a given ohmic resistance and passing through a cross hole as formed in ceramics material strip members.

The latter, in particular, are so shaped at two opposite walls thereof, in such a way as to be able of being mutually coupled thereby providing a structure which may be evenly bent, such as an annular band, which, on its outside, is restrained by a collar member.

The mentioned ceramics material strips have a constant length and are arranged in such a way as to form, in a single assembly, two or more parallelly extending ring members, which are conveniently spaced from one another.

On the other hand, the disclosed arrangement does not afford the possibility of precisely adjusting the heat supplied to the extruder, with consequent degradations of the plastics material.

In fact, as the process starts, it is necessary to supply the extruder with excess heat, in order to provide the material itself with a suitable fluidity; the operation of the known temperature adjusting devices, on the other hand, is not of a satisfactory accuracy, even due to the high thermal inertia of the assembly.

Accordingly, the overall assembly is presently enclosed in a jacket, effective to provide a perimetrical gap wherein cooling air is caused to circulate.

However, that approach is not completely satisfactory, since it is not capable of evenly distributing heat to the extruder apparatus.

SUMMARY OF THE INVENTION

Accordingly, the task of the present invention is that of overcoming the thereinabove mentioned drawbacks, by providing such an electric resistance heating assembly which is capable of supplying an even amount of heat through the overall heating surface thereof.

Within that task, it is a main object of the present invention to provide such an electric resistance heating assembly which is devoid of any auxiliary cooling devices, thereby reducing to a minimum the cost thereof.

Yet another object of the present invention is to provide such an electric resistance heating assembly, which is of very reduced size and greatly reliable.

According to one aspect of the present invention, the above task and objects, as well as yet other objects which will become more apparent thereinafter, are achieved by an electric resistance heating assembly, characterized in that it comprises coiled wire electric resistances, passing through one or more holes as transversely formed in ceramics material strips, said strips being so shaped as to be effective to be coupled to one another in a partial sliding relationship, along the longitudinal axes thereof, said strips having at least two different lengths, in such a way as to provide an interconnected structure, having void zones, said structure being engaged by said electric resistances and being restrained, on the outside thereof, by a net band, wound as a ring and provided with means for removably coupling its two end portions.

BRIEF DESCRIPTION OF THE DRAWINGS

Further characteristics and advantages of the electric resistance heating assembly according to the present invention will become more apparent thereinafter from the following detailed description of preferred embodiments of said heating assembly, being illustrated, by way of an example and not of limitation, in the figures of the accompanying drawing, where.

DESCRIPTION OF THE PREFERRED EMBODIMENT

With reference to the Figures of the accompanying drawings, the electric resistance heating assembly according to the invention comprises a plurality of ceramic material strips 1, having a substantially square cross-section and at least two different lengths.

The mentioned strips, in particular, are provided with two opposite walls, having respectively a concave and convex configuration and indicated at 1' and 1''.

Through the two mentioned walls, moreover, there are formed through holes 2, which extend through said strips, and are evenly spaced from one another.

Figure 2:
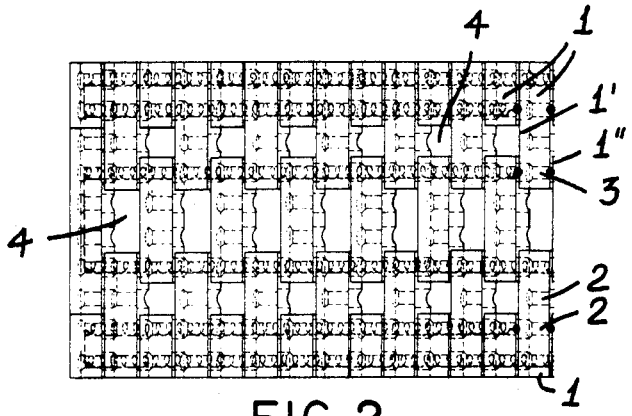
FIGS. 2, 3 and 4 illustrate some alternative embodiments, which are exemplary of possible coupling arrangements of the ceramics material strips and heating resistances therefor.
Figure 3:
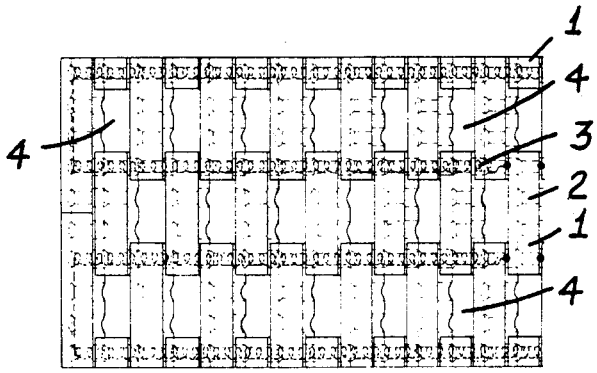
Figure 4:
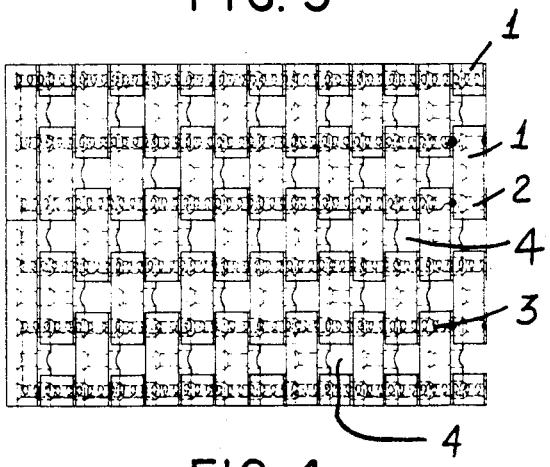

It should be noted that the coupling of the mentioned strips, in such a way as to form continuous bands, partially interconnected to one another, may be of any different types, as it is exemplarily shown in FIGS. 2, 3 and 4, provided that said strips are effective to jointly define a given number of continuous holes effective to house corresponding coiled resistances 3.

Accordingly, differently from the known heating assembly for like purposes, it is possible to provide, in the inventive assembly, void spaces 4 which are variously and evenly distributed through the overall heating surface.

Thus, it is possible to construct a heating assembly having a very reduced thermal inertia, and which, accordingly, may react in a very quick way to the requirements of the thermoadjusting devices.

Figure 1:
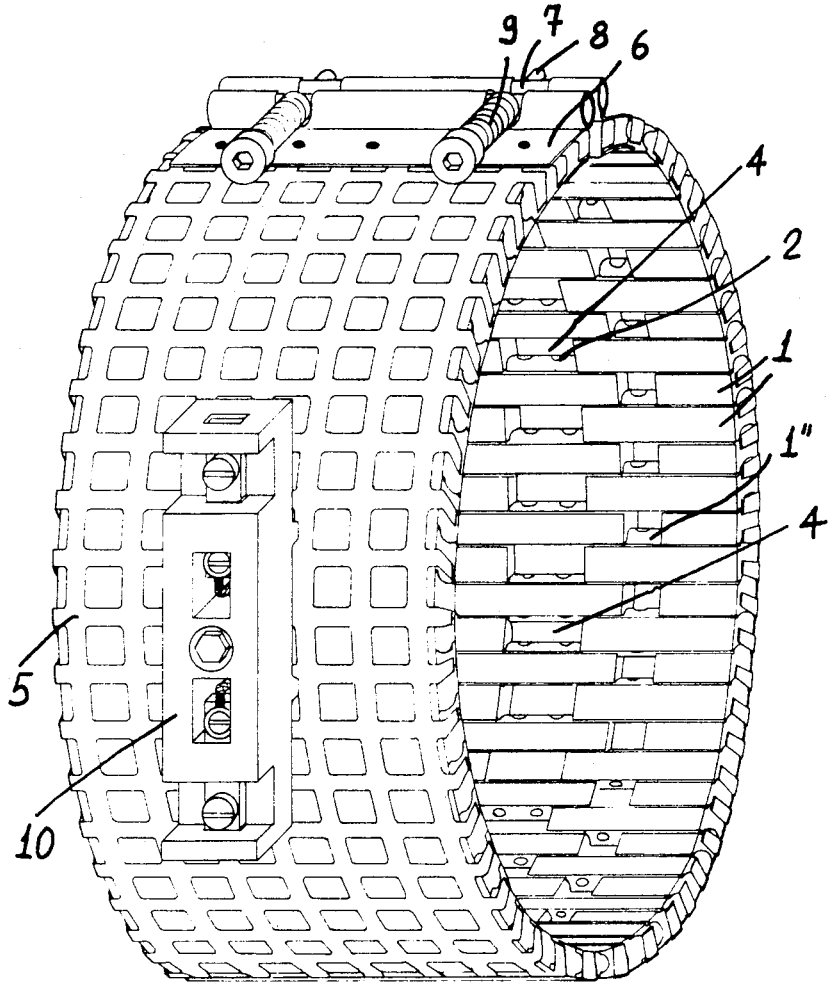
FIG. 1 is a perspective view illustrating the heating assembly according to the invention.

The several interconnected bands consisting of said ceramics strips are wound as a ring (FIG. 1), on a supporting perforated sheet metal or welded net supporting member 5, provided with a right angle bent edge 5' effective to laterally restrain said bands.

The supporting member, obviously, will be provided with clamping elements, consisting, preferably, of two U-shaped sections 6 effective to restrain the end portions of the bands and cantilever-wise supporting two rods 7 which are mutually coupled by through going screws 8, and with which tension spring 9 is effective to cooperate.

There is moreover provided a terminal board 10 whereat end the several mentioned coiled resistances.

From the above disclosure and the Figures of the accompanying drawings, will be self evident the great functionality and use facility characterizing the electric resistance heating assembly according to the present invention.

What is claimed is:

1. An electric resistance heating assembly, characterized in that it comprises a plurality of ceramics material strips wound as a ring and coiled wire electric resistances (3), passing through at least two holes as transversely formed in said ceramics material strips (1), means for coupling said strips to one another in a partial sliding relationship, along the longitudinal axes thereof, said strips having at least two different lengths, in such a way as to provide an interconnected structure, having void zones, said ceramics material strips having a substantially square cross-section and being provided with two opposite walls (1', 1''), having respectively a concave and convex configuration, whereat there are formed evenly spaced through holes (2).

2. A heating assembly, according to claim 1, characterized in that bands, variously interconnected, of said ceramic material strips, are supported by a perforated sheet metal supporting member (5) provided with a right angle bent edge (5') effective to laterally restrain said bands.

3. An electric resistance heating assembly, characterized in that is comprises a plurality of ceramics material strips wound as a ring and coiled wire electric resistances (3), passing through at least two holes as transversely formed in said ceramics material strips (1), means for coupling said strips to one another in a partial sliding relationship, along the longitudinal axes thereof, said strips having at least two different lengths, in such a way as to provide an interconnected structure, having void zones, said ceramics material strips having a substantially square cross-section and being provided with two opposite walls (1', 1''), having respectively a concave and convex configuration, whereat there are formed evenly spaced through holes (2), and characterized in that bands, variously interconnected, of said ceramic material strips, are supported by a perforated sheet metal supporting member (5) provided with a right angle bent edge (5') effective to laterally restrain said bands, and characterized in that said supporting member (5) is provided with clamping elements (6) consisting of two U-shaped sections effective to restrain the end portions of said bands and cantilever-wise supporting two rods (7), coupled by through going screws (8) wherewith tension springs (9) are effective to cooperate, said supporting member (5) supporting moreover a terminal board (10) whereat end said coiled resistances (3).

* * * * *